US010153592B2

(12) United States Patent
Patel

(10) Patent No.: US 10,153,592 B2
(45) Date of Patent: Dec. 11, 2018

(54) COMMUNICATIONS CONNECTORS

(71) Applicant: Panduit Corp., Tinley Park, IL (US)

(72) Inventor: Satish I. Patel, Roselle, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 15/943,928

(22) Filed: Apr. 3, 2018

(65) Prior Publication Data

US 2018/0226752 A1 Aug. 9, 2018

Related U.S. Application Data

(63) Continuation of application No. 14/873,314, filed on Oct. 2, 2015, now Pat. No. 9,966,703.

(60) Provisional application No. 62/065,245, filed on Oct. 17, 2014.

(51) Int. Cl.

| | |
|---|---|
| ***H01R 13/64*** | (2006.01) |
| ***H01R 13/6461*** | (2011.01) |
| ***H01R 43/16*** | (2006.01) |
| ***H01R 13/15*** | (2006.01) |
| ***H01R 13/6466*** | (2011.01) |
| *H01R 24/64* | (2011.01) |
| *H01R 107/00* | (2006.01) |

(52) U.S. Cl.

CPC ..... *H01R 13/6461* (2013.01); *H01R 13/15* (2013.01); *H01R 13/6466* (2013.01); *H01R 43/16* (2013.01); *H01R 24/64* (2013.01); *H01R 2107/00* (2013.01); *H01R 2201/04* (2013.01)

(58) Field of Classification Search

CPC ..... H01R 13/6461; H01R 13/6463; H01R 13/6464; H01R 13/6466; H01R 13/6467; H01R 13/6469; H01R 13/646; H01R 24/64

See application file for complete search history.

(56) References Cited

U.S. PATENT DOCUMENTS

| | | | |
|---|---|---|---|
| 6,079,996 | A | 6/2000 | Arnett |
| 6,102,722 | A | 8/2000 | Arnett |
| 6,116,964 | A | 9/2000 | Goodrich et al. |
| 6,156,981 | A | 12/2000 | Ward et al. |
| 6,244,908 | B1 | 6/2001 | Hammond et al. |
| 6,358,093 | B1 | 3/2002 | Phommachanh et al. |
| 6,394,853 | B1 | 5/2002 | Hammond et al. |
| 6,409,547 | B1 | 6/2002 | Reede |
| 6,736,681 | B2 | 5/2004 | Arnett |

(Continued)

FOREIGN PATENT DOCUMENTS

WO WO2008058464 A1 5/2008

*Primary Examiner* — Ross N Gushi

(74) *Attorney, Agent, or Firm* — Christopher S. Clancy; James H. Williams

(57) ABSTRACT

Disclosed are various embodiments of communications connectors. In one example, a communications jack includes a housing, a sled assembly, a printed circuit board, and a plurality of intermediate contacts. The sled assembly sled assembly is movable within the housing when a communications plug is inserted in the housing. The sled assembly includes a sled and a sled PCB connected to the sled. The sled assembly also includes a plurality of plug interface contacts (PICs) connected to the sled PCB. The intermediate contacts are connected to the sled PCB at first ends of the intermediate contacts, and are connected to the other PCB at second ends of the intermediate contacts.

10 Claims, 24 Drawing Sheets

(56) References Cited

U.S. PATENT DOCUMENTS

| | | | | |
|---|---|---|---|---|
| 7,001,221 | B2 | 2/2006 | Chen | |
| 7,086,909 | B2 | 8/2006 | Colantuono et al. | |
| 7,172,466 | B2 | 2/2007 | Aekins et al. | |
| 7,175,476 | B2 | 2/2007 | Kim et al. | |
| 7,364,470 | B2 | 4/2008 | Hashim | |
| 7,367,849 | B2 | 5/2008 | Wang et al. | |
| 7,427,218 | B1 | 9/2008 | Hashim et al. | |
| 7,544,088 | B2 | 6/2009 | Caveney et al. | |
| 7,658,648 | B2 | 2/2010 | Aekins | |
| 7,780,480 | B2 * | 8/2010 | Caveney | H01R 13/6658 439/676 |
| 7,785,154 | B2 | 8/2010 | Peng | |
| 7,857,635 | B2 | 12/2010 | Goodrich et al. | |
| 7,892,040 | B2 | 2/2011 | Ellis et al. | |
| 7,967,645 | B2 | 6/2011 | Marti et al. | |
| 7,976,348 | B2 | 7/2011 | Aekins et al. | |
| 7,985,100 | B2 * | 7/2011 | Jaouen | H01R 24/64 439/676 |
| 8,011,972 | B2 | 9/2011 | Caveney et al. | |
| 8,021,197 | B2 | 9/2011 | Milette et al. | |
| 8,167,661 | B2 | 5/2012 | Straka et al. | |
| 8,287,317 | B2 | 10/2012 | Straka et al. | |
| 8,303,348 | B2 | 11/2012 | Straka et al. | |
| 8,425,261 | B2 | 4/2013 | Pepe | |
| 8,480,439 | B1 | 7/2013 | Chen et al. | |
| 8,650,750 | B2 | 2/2014 | Engels et al. | |
| 8,696,386 | B2 | 4/2014 | Larsen et al. | |
| 8,702,442 | B2 | 4/2014 | Debenedictis et al. | |
| 8,826,532 | B2 | 9/2014 | Caveney et al. | |
| 8,915,757 | B2 * | 12/2014 | Fitzpatrick | H01R 13/15 439/676 |
| 9,246,254 | B2 * | 1/2016 | Vaden | H01R 13/33 |
| 2009/0186532 | A1 | 7/2009 | Goodrich et al. | |
| 2011/0237136 | A1 | 9/2011 | Straka et al. | |
| 2012/0188865 | A1 | 7/2012 | Michaelis et al. | |
| 2013/0109225 | A1 | 5/2013 | Liu | |
| 2014/0038461 | A1 | 2/2014 | Caveney et al. | |
| 2014/0073197 | A1 | 3/2014 | Fitzpatrick | |
| 2014/0127943 | A1 | 5/2014 | Liang | |
| 2014/0148057 | A1 | 5/2014 | Patel et al. | |
| 2014/0162477 | A1 | 6/2014 | Fitzpatrick | |
| 2014/0206240 | A1 | 7/2014 | Schumacher et al. | |
| 2014/0213120 | A1 | 7/2014 | Fitzpatrick | |
| 2014/0248807 | A1 | 9/2014 | Babu et al. | |
| 2014/0256185 | A1 | 9/2014 | Fransen et al. | |
| 2014/0256190 | A1 | 9/2014 | Caveney et al. | |
| 2014/0256191 | A1 | 9/2014 | Caveney et al. | |
| 2014/0273570 | A1 | 9/2014 | Fransen et al. | |
| 2014/0273638 | A1 | 9/2014 | Valenti et al. | |
| 2014/0287609 | A1 | 9/2014 | Fransen et al. | |
| 2014/0342610 | A1 | 11/2014 | Hashim | |

* cited by examiner

COMMUNICATIONS CONNECTORS

CROSS-REFERENCE TO RELATED APPLICATIONS

This application is a continuation of, and claims the benefit of priority to, U.S. application Ser. No. 14/873,314, filed on Oct. 2, 2015 (now allowed), which claims the benefit of priority to U.S. Provisional Patent Application No. 62/065,245, filed on Oct. 17, 2014. The entireties of which are incorporated herein by reference.

FIELD OF INVENTION

Embodiments of the present invention generally relate to the field of telecommunication infrastructure and more specifically to communication connectors such as RJ45 jacks.

BACKGROUND

RJ45 connectors have come to be extensively used within the realm of network communication. RJ45 plugs typically have eight plug contacts arranged in a row and configured to interface eight plug interface contacts (PICs) provided in an RJ45 jack. The closely spaced parallel conductors which allow the jack and the plug to interface to each other produce a known amount of crosstalk (set by an ANSI/TIA (American National Standards Institute/Telecommunications Industry Association) standard) between any two wire-pairs. To maintain the integrity of the signal through the plug/jack connector combination, this offending crosstalk may be canceled or reduced by a compensating signal within the jack.

The crosstalk compensation can generally be simplified by shortening the distance from the plug/jack contact point on the PICs (approximate location of the source of crosstalk in a mated plug and jack combination) to the crosstalk compensation network employed within the jack. Shortening of this distance simplifies the jack crosstalk compensation by reducing the phase delay between the plug/jack contact point and the crosstalk compensation network. For a fixed physical distance between the plug/jack contact point and the jack crosstalk compensation network phase delay is a function of frequency (increasing with frequency) and an RJ45 jack typically needs to be tuned for a range of frequencies (1 to 500 MHz for CAT6A, for example). Consequently, reduction of the above-mentioned phase delay tends to increase the bandwidth of the jack.

While the theoretical desire to shorten the crosstalk-to-compensation distance is known, real-world implementations of jacks employing such design features are hampered by constraints such as, for example, manufacturing costs and form factor requirements. Furthermore, jacks are required to be compatible with mating plug contacts at the limits of size and position tolerances allowed by governing standard bodies. For instance, to allow for proper plug latching, a jack housing latch stop face is designed to have plug over-travel. However, such design requirements can have an undesired effect on the crosstalk-to-compensation distance.

Therefore, there continues to be a need for improved communication jack designs which reduce and/or maintain the electrical distance from the crosstalk to the initial stage of compensation.

SUMMARY

Accordingly, at least some embodiments of the present invention are directed towards jack designs which reduce and/or maintain the electrical distance from the crosstalk to the initial stage of compensation.

In an embodiment, the present invention is an RJ45 network jack which includes a front sled PCB assembly incorporating short PICs, a compensation printed circuit board, and a spring-loaded movement designed to provide a portion of the total displacement necessary to accommodate plug travel of a mated plug. The PICs are capable of displacement which is designed to be adequate to provide reliable contact while mating with a plug. The PICs feature individual supports that control the PIC bend radius and limit the PIC displacement. After the PICs bottom out on the supports, added plug travel results in the sled PCB assembly displacement against the spring load which provides added normal force to assure a reliable interface with a mated plug. The spring load further acts to return the sled assembly to its original (resting) position in an unmated state.

In another embodiment, the present invention is a communication connector for connection with a communication plug. The communication connector includes a housing including a plug receiving aperture, and a sled assembly at least partially received within the plug receiving aperture, the sled assembly including a sled and a crosstalk compensation apparatus connected to the sled, the sled assembly further including a plurality of plug interface contacts connected to the crosstalk compensation apparatus, the sled assembly at least partially movable within the housing when the communication plug is inserted in the housing. Such a communication plug may be a part of a larger communication system which includes communication equipment.

In yet another embodiment, the present invention is a method of making contact between a communication plug, having a plurality of plug contacts, and a communication jack, having a plurality of plug interface contacts. The method includes the steps of inserting the communication plug into the communication jack, impinging the plug contacts on respective plug interface contacts, and moving the plug interface contacts to maintain an approximately predetermined distance between a point of contact of the plug contacts and the plug interface contacts, and a first compensation stage.

These and other features, aspects, and advantages of the present invention will become better understood with reference to the following drawings, description, and any claims that may follow.

DETAILED DESCRIPTION

Figure 1:
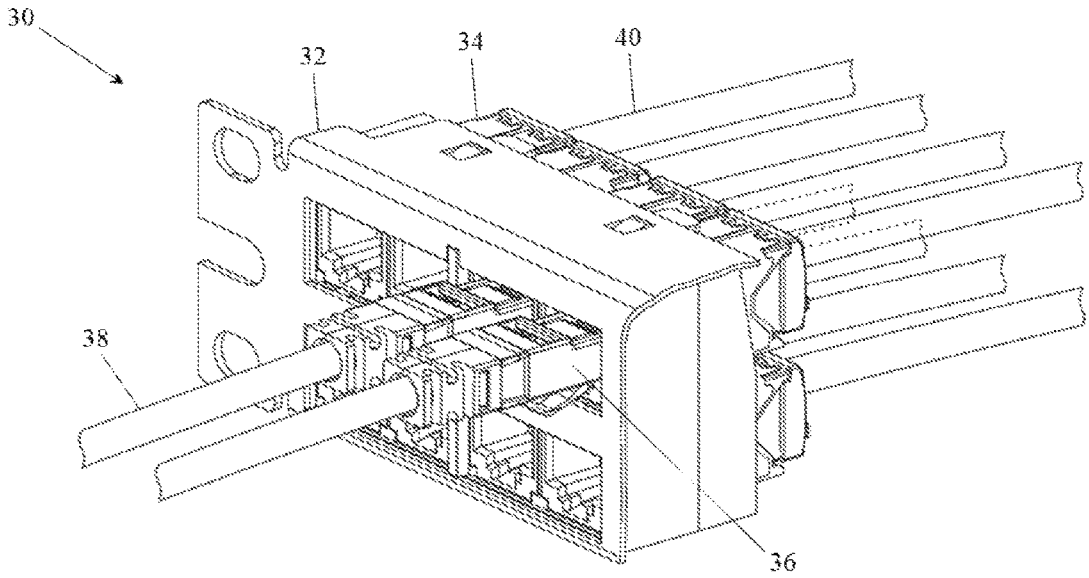
FIG. 1 illustrates a perspective view of a communication system according to an embodiment of the present invention.

An exemplary embodiment of the present invention is illustrated in FIG. 1, which shows a communication system 30, which includes a patch panel 32 with jacks 34 and corresponding RJ45 plugs 36. Respective cables 38 are terminated to plugs 36, and respective cables 40 are terminated to jacks 34. Once a plug 36 mates with a jack 34, data can flow in both directions through these connectors. Although the communication system 30 is illustrated in FIG. 1 as having a patch panel, alternative embodiments can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and or telecommunications rooms; security devices (cameras and other sensors, etc.) and door access equipment; and telephones, computers, fax machines, printers, and other peripherals as can be found in workstation areas. Communication system 30 can further include cabinets, racks, cable management and overhead routing systems, and other such equipment.

Figure 2:
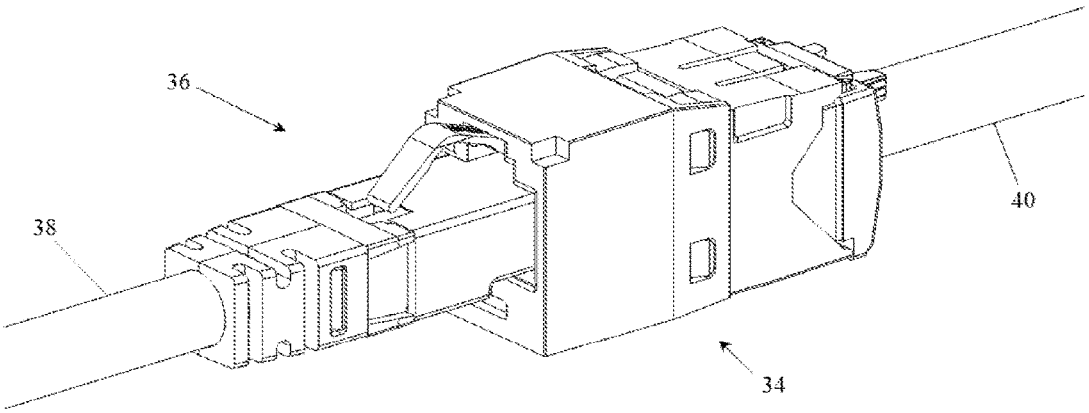
FIG. 2 illustrates a plug/jack combination according to an embodiment of the present invention.

The jack and plug combination of FIG. 1 is also shown in FIG. 2 which illustrates the network jack 34 mated with the RJ45 plug 36. Note that in this figure, the orientation of the network jack 34 and the RJ45 plug 36 is rotated 180° about the central axis of cable 40 as compared to the orientation of FIG. 1.

Figure 3:
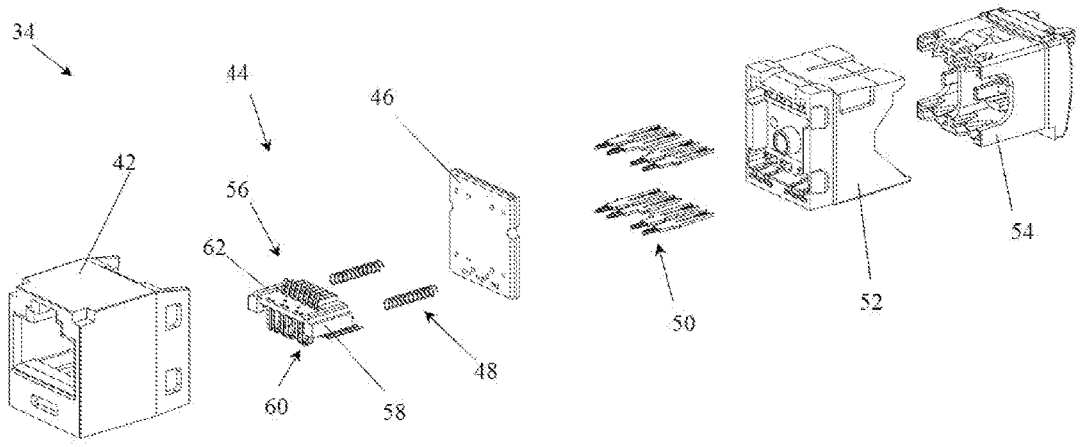
FIG. 3 illustrates an exploded view of a communication jack according to an embodiment of the present invention.

FIG. 3 illustrates an exploded view of the network jack 34, which includes a front housing 42, a front sled assembly 44, a vertical printed circuit board (PCB) 46 (which in some embodiments may have crosstalk compensation components thereon), resilient member or springs 48, insulation displacement contacts (IDCs) 50, a rear housing 52, and a wire cap 54. In some embodiments, the jack 34 can additionally include alien crosstalk-reducing materials such as a foil. Additionally, while the springs 48 are shown as compression helical wound springs, other embodiments of resilient member 48 can be implemented as stamped or spiral springs, or they can be configured to be extension springs, torsion springs, or other resilient members.

Figure 4:
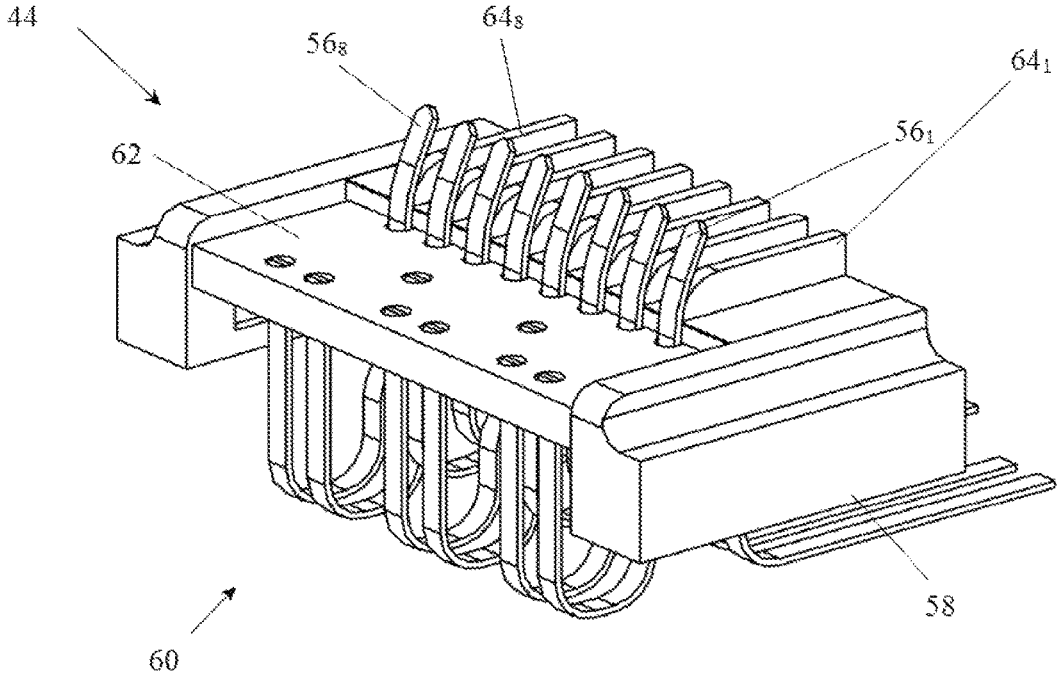
FIG. 4 illustrates the front sled assembly of the jack of FIG. 3.
Figure 5:
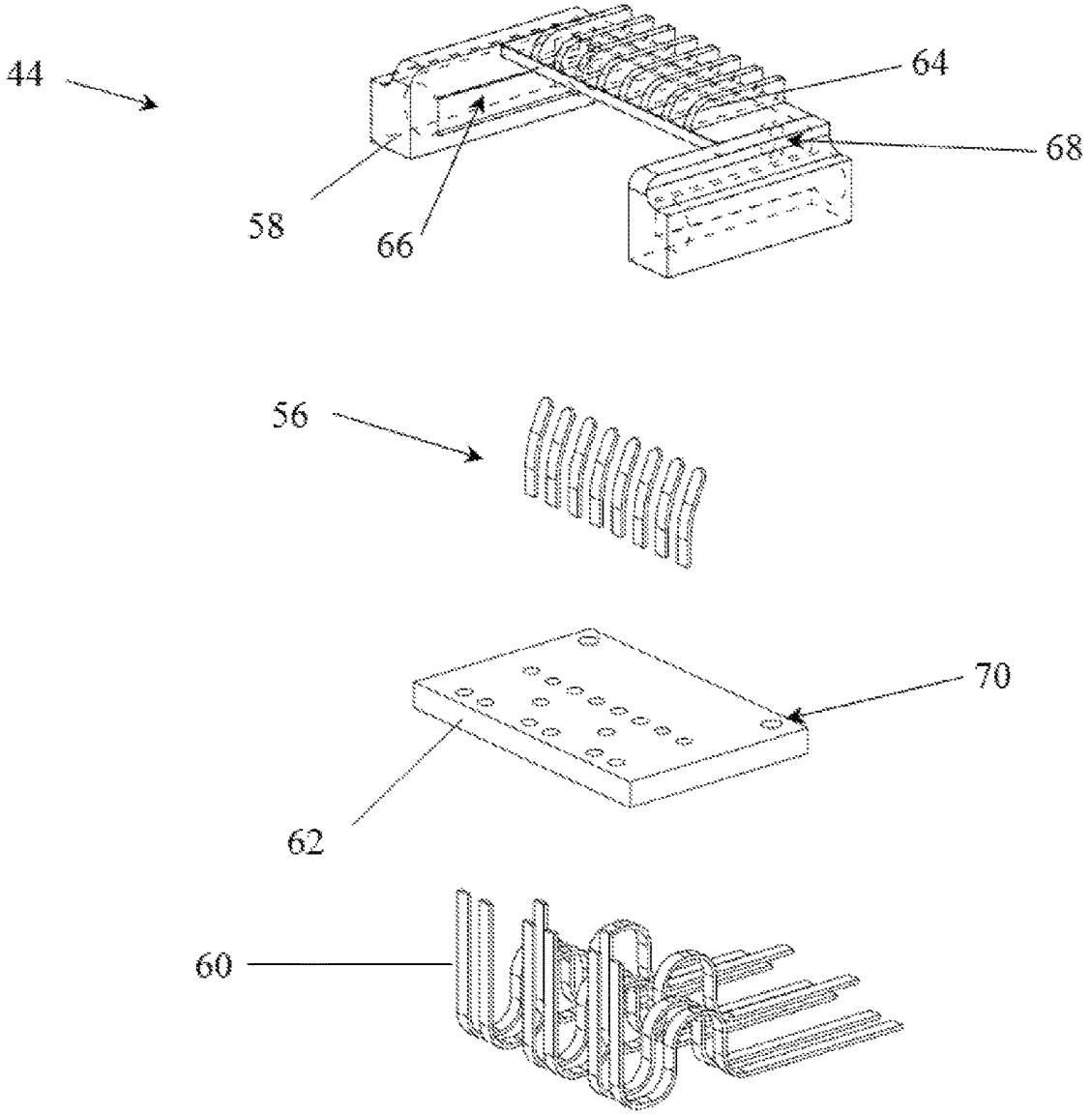
FIG. 5 illustrates an exploded view of the front sled assembly of FIG. 4.

FIGS. 4 and 5 illustrate the front sled assembly 44 with a sled 58, PICs 56, intermediate contacts 60, PCB 62, and PIC supports 64 in greater detail. The subscript numbers of each PIC 56 and each PIC support 64 correspond to the RJ45 pin positions as defined by ANSI/TIA-568-C.2.

The sled 58 can be made from any suitable material including plastic. It includes two spring pockets 66 which comprise elongated cavities positioned along the bottom of each side of the sled with openings towards the rear of the jack 34. The pockets 66 can be of any shape and with the exception of the rear openings may be partially or fully enclosed so long as they can securely house springs 48 such that the springs 48 will not dislodge from their intended position in their default and/or compressed positions. The sled 58 further includes a receiving area for a first PCB 62 which in some embodiments may have crosstalk compensation circuitry and/or other signal conditioning circuitry thereon.

The PCB 62 includes eight vias for receiving PICs $\mathbf{56}_1$-$\mathbf{56}_8$, and another eight vias for receiving intermediate contacts 60 which electrically connect the first PCB 62 to the vertical PCB 46. Compared to conventional PICs, PICs 56 have a relatively short length. In an embodiment, the length of PICs can be between 0.060 inches and 0.125 inches. PICs 56 can have a layered construction, such as, for example, those disclosed in U.S. Patent Publication No. 2014/0148057 to Patel et al., which is incorporated herein by reference in its entirety.

Figure 6:
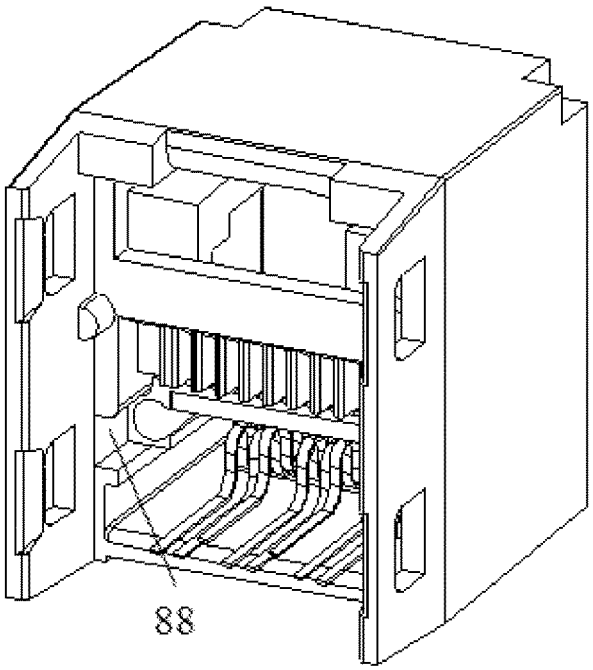
FIG. 6 illustrates a rear perspective view of the front housing of the jack of FIG. 3.

In an embodiment, the front sled assembly 44 is fabricated by first inserting the PCB 62 into the sled 58. The PCB 62 and the sled 58 are held together by staking sled's rectangular post features 68 after fitting them through the PCB holes 70. Formed PICs 56 and the intermediate contacts 60 can then be assembled to PCB 62 such that the PICs $\mathbf{56}_1$-$\mathbf{56}_8$ are positioned in front of the respective PIC supports $\mathbf{64}_1$-$\mathbf{64}_8$. Referring to FIG. 6, once assembled, the front sled assembly 44 is mounted within the front housing's guide rails 88. The guide rails 88 support the assembly 44 and constrain its movement in at least some directions while allowing some degree of forward and backward movement.

Figure 7:
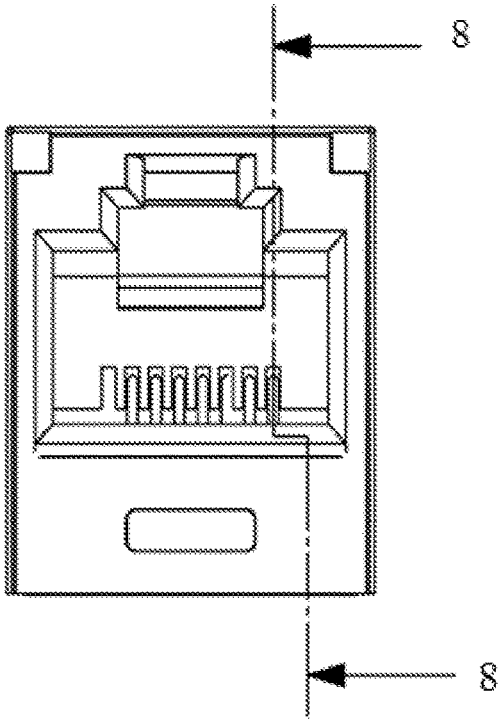
FIG. 7 illustrates a front view of the jack of FIG. 3.
Figure 8:
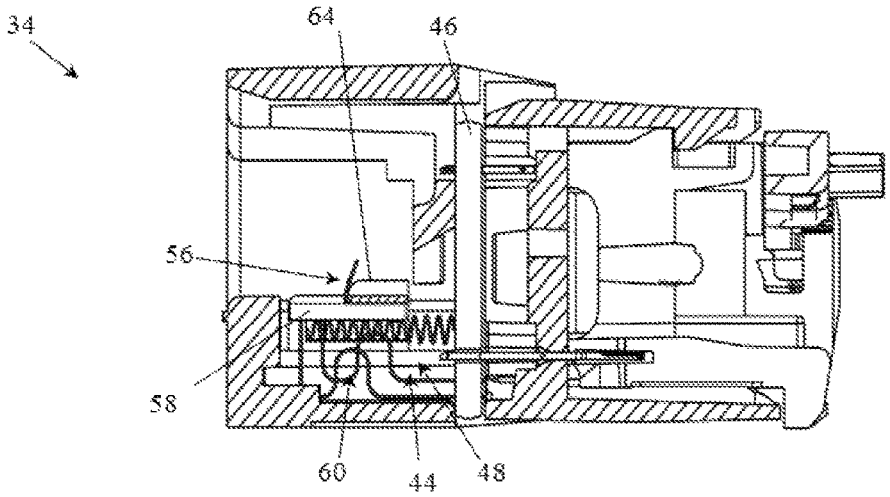
FIG. 8 illustrates a cross-sectional view of the jack of FIG. 3 in an unmated state, taken along section line 8-8 in FIG. 7.

A cross-sectional view of an assembled jack 34 taken along the section line 8-8 in FIG. 7 is visible in FIG. 8. This view illustrates the default position of the jack's internal components when the jack is in an unmated state. In this state, the springs 48 push the front sled assembly 44 into a forward-biased default position closer to the front of the jack's opening. At this stage, the PICs 56 are also in their default non-deflected position.

Figure 9:
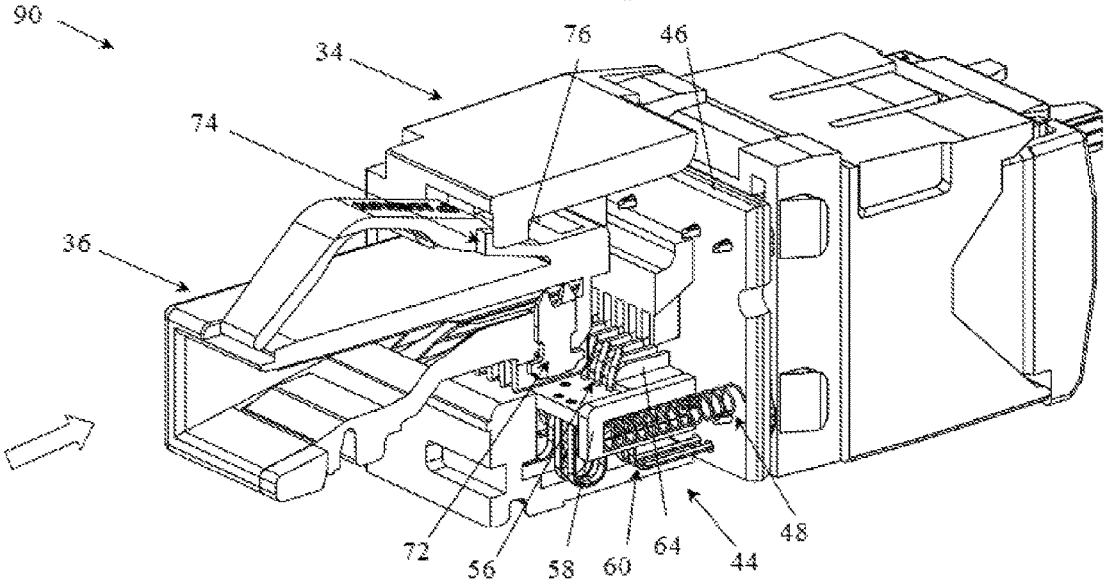
FIG. 9 illustrates a fragmentary perspective view of the jack of FIG. 3 together with a plug in an unmated state.
Figure 10A:
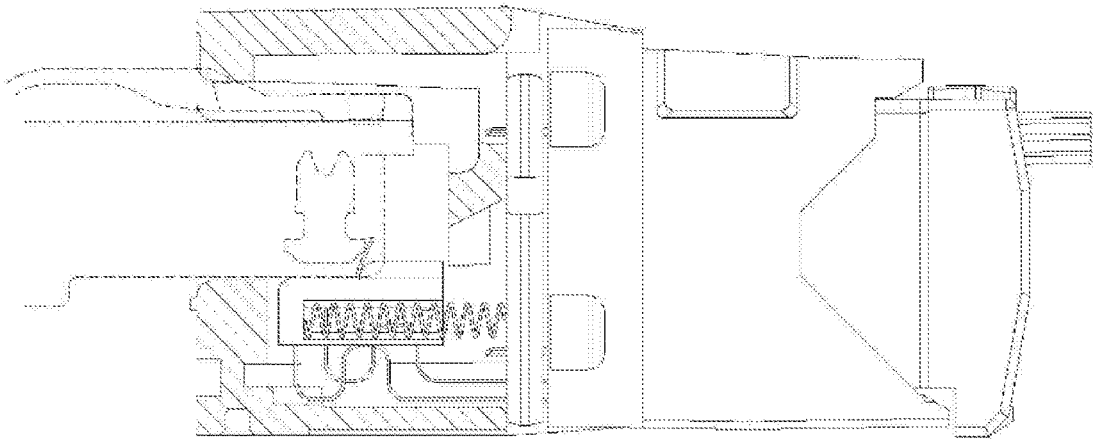
FIG. 10A illustrates a cross-sectional view of the jack of FIG. 3 together with a plug in a partially mated state.
Figure 10B:
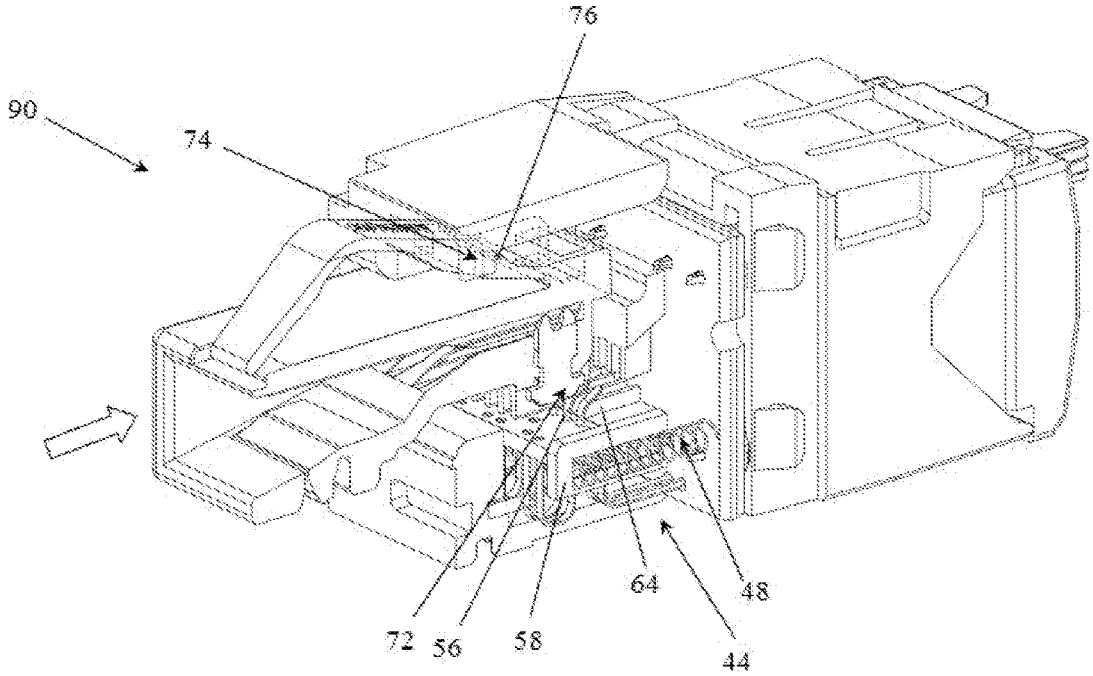
FIG. 10B illustrates a perspective view of the jack of FIG. 3 together with a plug in a partially mated state.
Figure 11A:
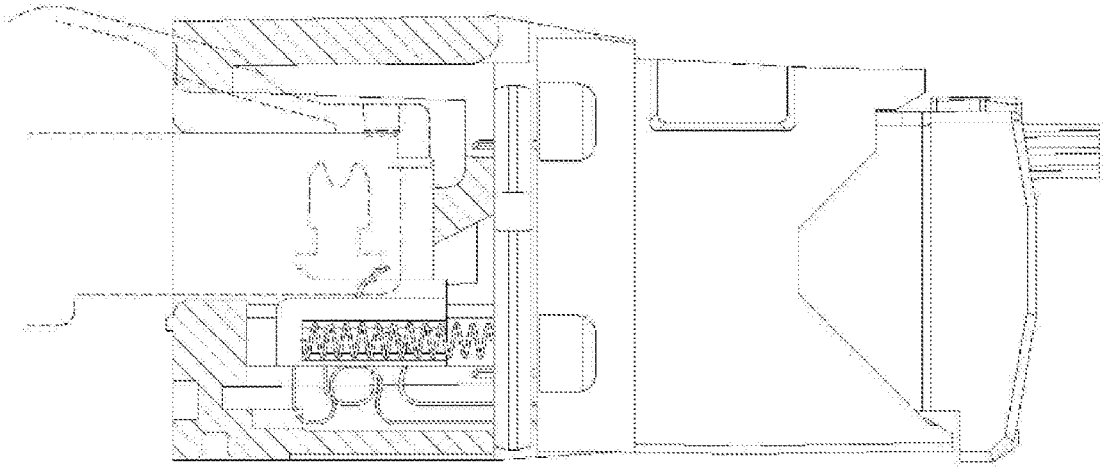
FIG. 11A illustrates a cross-sectional view of the jack of FIG. 3 together with a plug in a mated state.
Figure 11B:
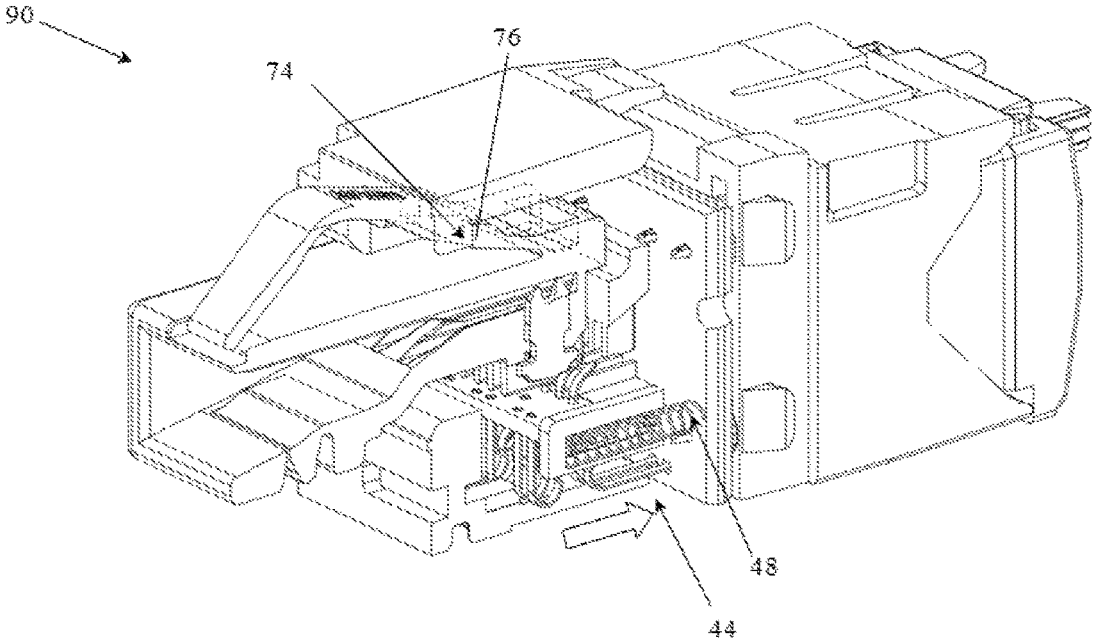
FIG. 11B illustrates a perspective view of the jack of FIG. 3 together with a plug in a mated state.

FIGS. 9-11B illustrate the interaction of the jack 34 with the plug 36 as the connector set goes from an unmated state to a fully latched state. In FIG. 9, the plug/jack assembly 90 is shown with plug 36 at the early stage of insertion into jack 34. At this point, the plug contacts 72 have not yet engaged PICs 56 and the plug latch stop 74 is some distance away from the jack housing's 42 latch stop 76. Additionally, at this stage the front sled assembly 44 is pushed fully into its forward position closer to the front of the housing 42 by the springs 48. As the plug 36 is pushed further into the jack 36, the plug contacts 72 of the plug 36 begin to come into contact with the PICs 56. This can be seen in FIGS. 10A and 10B where the forward force of the contacts 72 begins to deform and deflect the PICs 56. To keep the deformation of the PICs 56 within an elastic range and prevent plastic deformation, respective PIC supports 64 are positioned behind each of the PICs 56. The PIC supports 64 provide bend radius and deformation control as the PICs 56 deform, preventing any one of the PICs 56 from deflecting past a certain point. PICs 56 deformation over PIC support 64 is preferably designed to provide adequate wiping and contact for plug contacts 72 at the limits of position and size tolerance as allowed by the governing standards. In addition to the PIC supports 64, to maintain the PICs' 56 deformations in an elastic range while having adequate normal force, PICs 56 can have a layered construction as noted previously. After the PICs 56 bottom out against the PIC supports 64, the forward force of the plug being inserted into the jack transfers to the front sled assembly 44 which in turn starts to compress springs 48 and slide rearward within the jack along the guide rails 88. This can be seen in the illustration of FIGS. 11A and 11B. The compression of the springs 48 provides additional normal force at the interface between the PICs 56 and the plug contacts 72.

To accommodate the rear movement of the front sled assembly 44 and the static position of the vertical PCB, the intermediate contacts 60 are designed to non-plastically deform/compress as the front sled assembly 44 is pushed back during the plug/jack mating process. In the currently described embodiment, this deformation/compression of contacts 60 is allowed for by the implementation of the "S" curved section which allow the deformation of the contacts 60 to remain in an elastic range.

Figure 12:
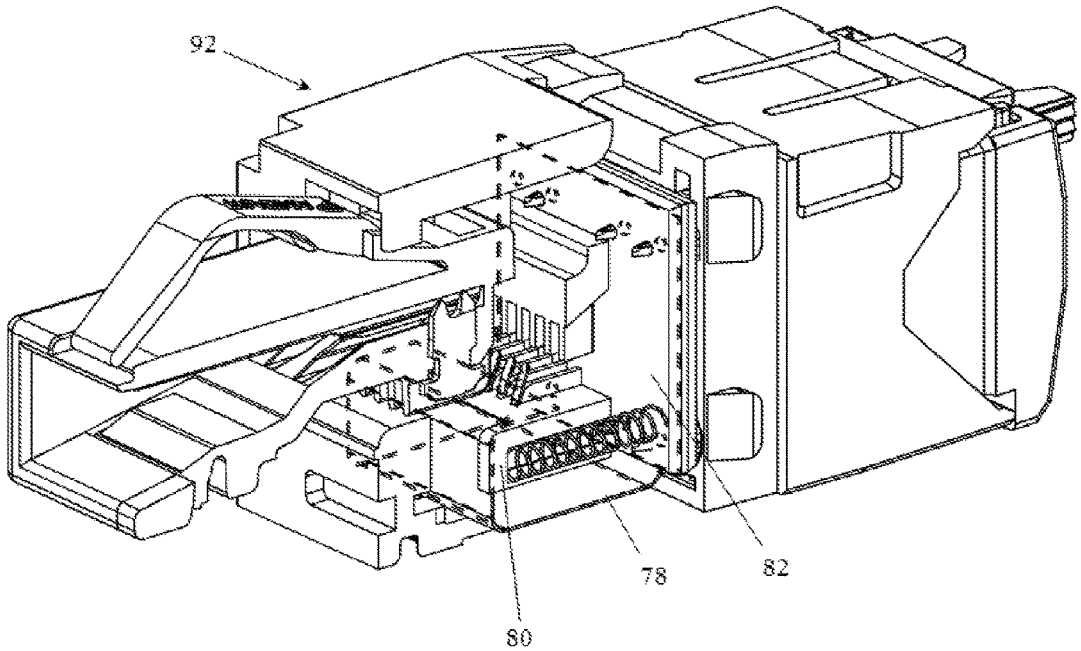
FIG. 12 illustrates a jack according to an embodiment of the present invention.

An alternate embodiment of the present invention is shown in FIG. 12, and includes a jack 92 with a flexible PCB 78, a sled 80, and a support 82. The sled 80 is designed to provide a rigid support for flexible PCB encapsulation to facilitate the mounting of PICs 56. Plastic support 82 also encapsulates the flexible PCB to provide rigid support for IDCs 50 mounting and support during wire cap 54 termination. In another embodiment, the flexible PCB 78 may replace the intermediate contacts 60 of the previous embodiment, whereby the first PCB 62 and the vertical PCB 46 would still remain. Implementing the flex PCB 78 may allow for a compensation network to be positioned closer to the source of the crosstalk.

Figure 13A:
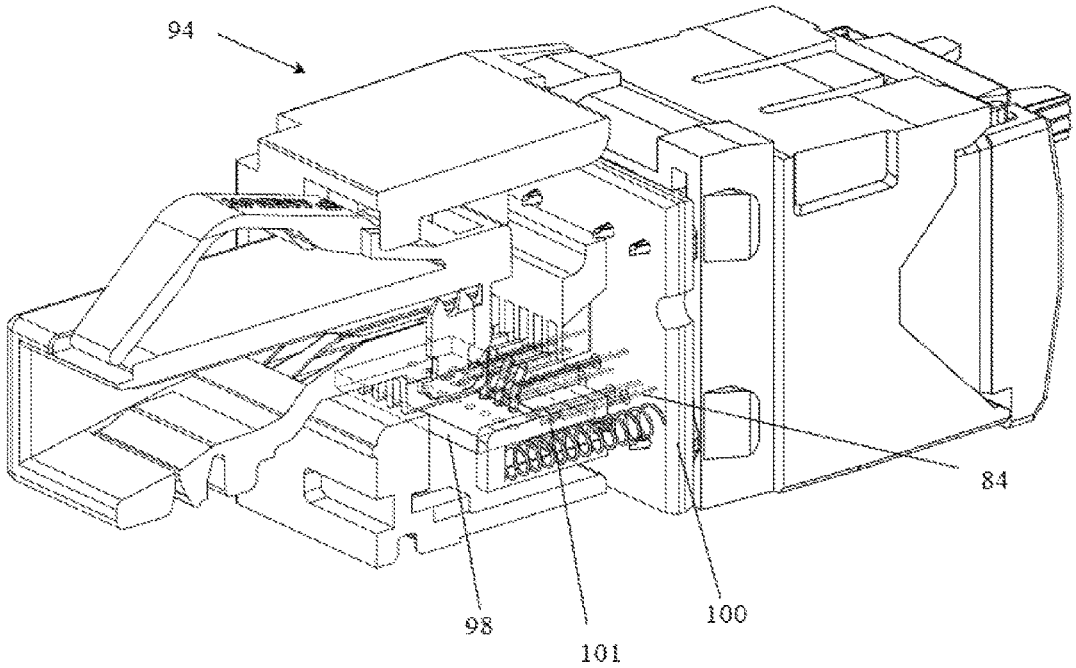
FIGS. 13A and 13B illustrate a jack according to an embodiment of the present invention.
Figure 13B:
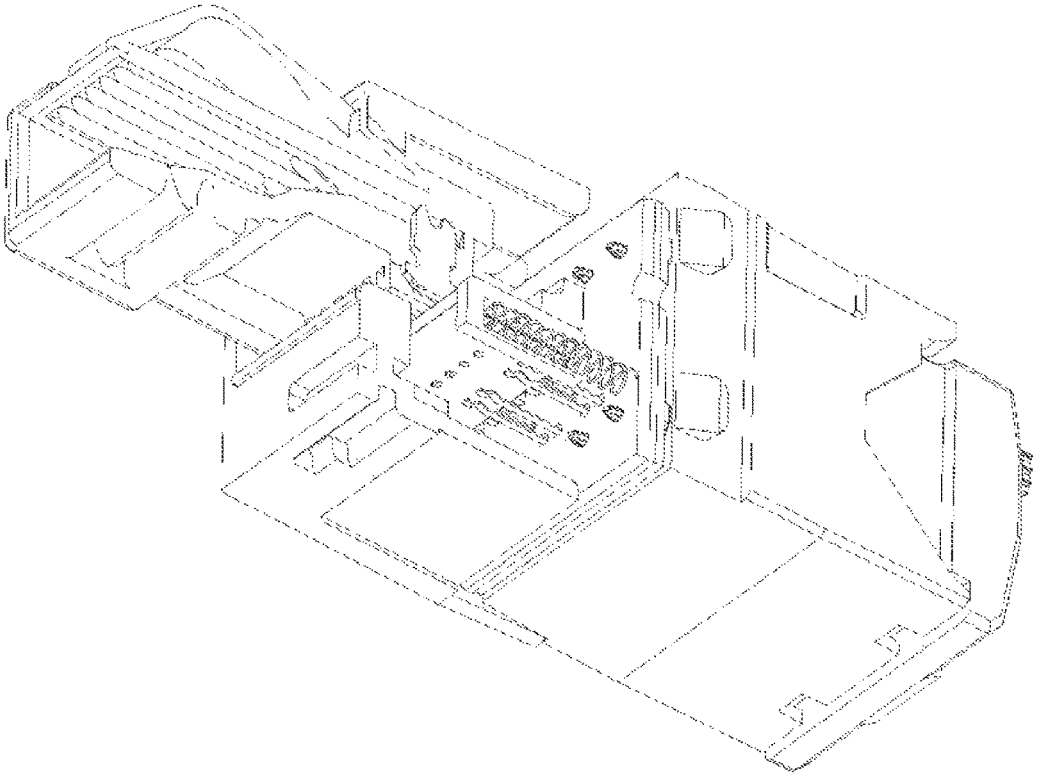

Yet another alternate embodiment of the present invention is shown in FIGS. 13A and 13B, where intermediate contacts 60 are replaced with intermediate contacts 84. The intermediate contacts 84 are mounted to the vertical PCB 100 at one end and at another end feature wiping arms 101 which wipe against contact pads positioned on the bottom of the PCB 98. As the front sled assembly along with the PCB 98 travel into their rearward position upon mating with a corresponding plug, contact pads positioned on the bottom of the PCB 98 slide into position or keep contact with the wiping arms 101, allowing data to flow between the PICs and the vertical PCB 100.

Figure 14:
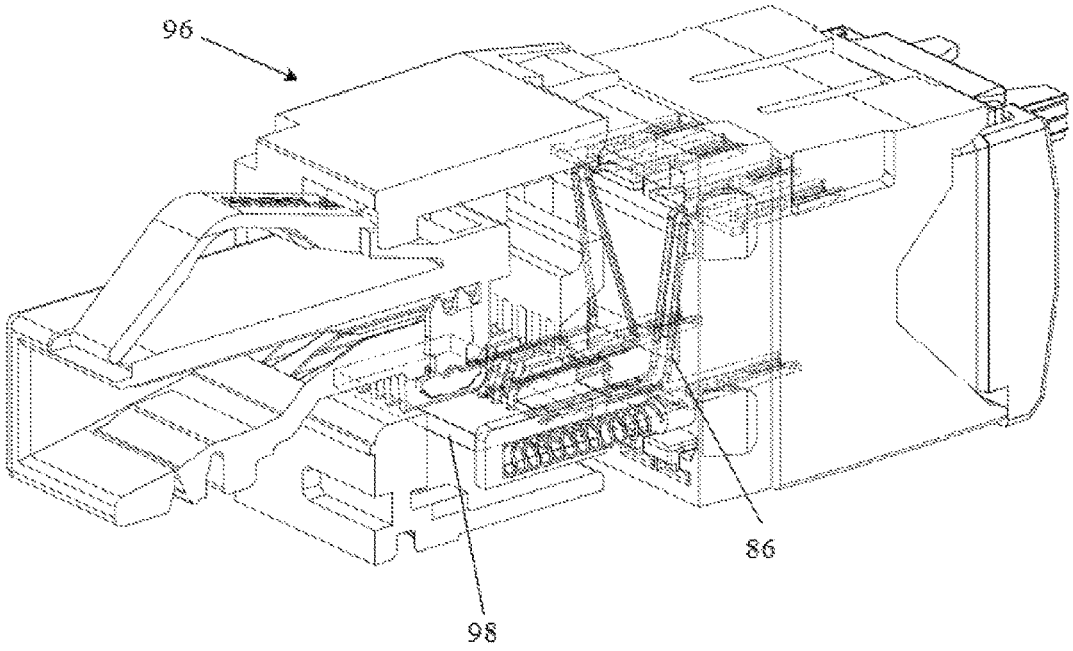
FIG. 14 illustrates a jack according to an embodiment of the present invention.

Yet another alternate embodiment of the present invention is shown in FIG. 14 where the vertical PCB of the embodiment shown in FIGS. 13A and 13B is replaced by lead-frame style contacts, whereby the lead-frame style contacts span from the wiping arms 101 to the IDCs.

Figure 15:
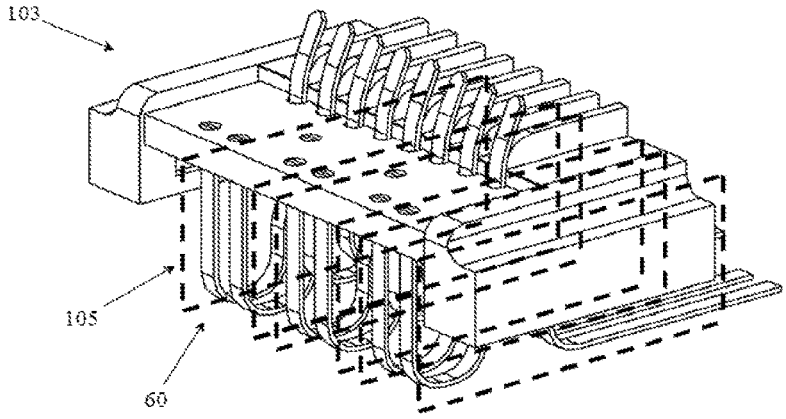
FIG. 15 illustrates an embodiment of a front sled assembly for use in a jack according to an embodiment of the present invention.

FIG. 15 illustrates yet another alternate embodiment according to the present invention where the front sled assembly 103 has shielding partitions 105 to selectively isolate contacts 60. Shielding partitions 105 can be made of conductive or semi-conductive material and can be floating or grounded. The shielding partitions 105 can also be connected to the PCB or they can be part of jack housing, or otherwise. In addition, the shielding partitions can be formed in any desired shape and/or size to accommodate the front sled assembly 103 and associated jack housing geometries.

Figure 18:
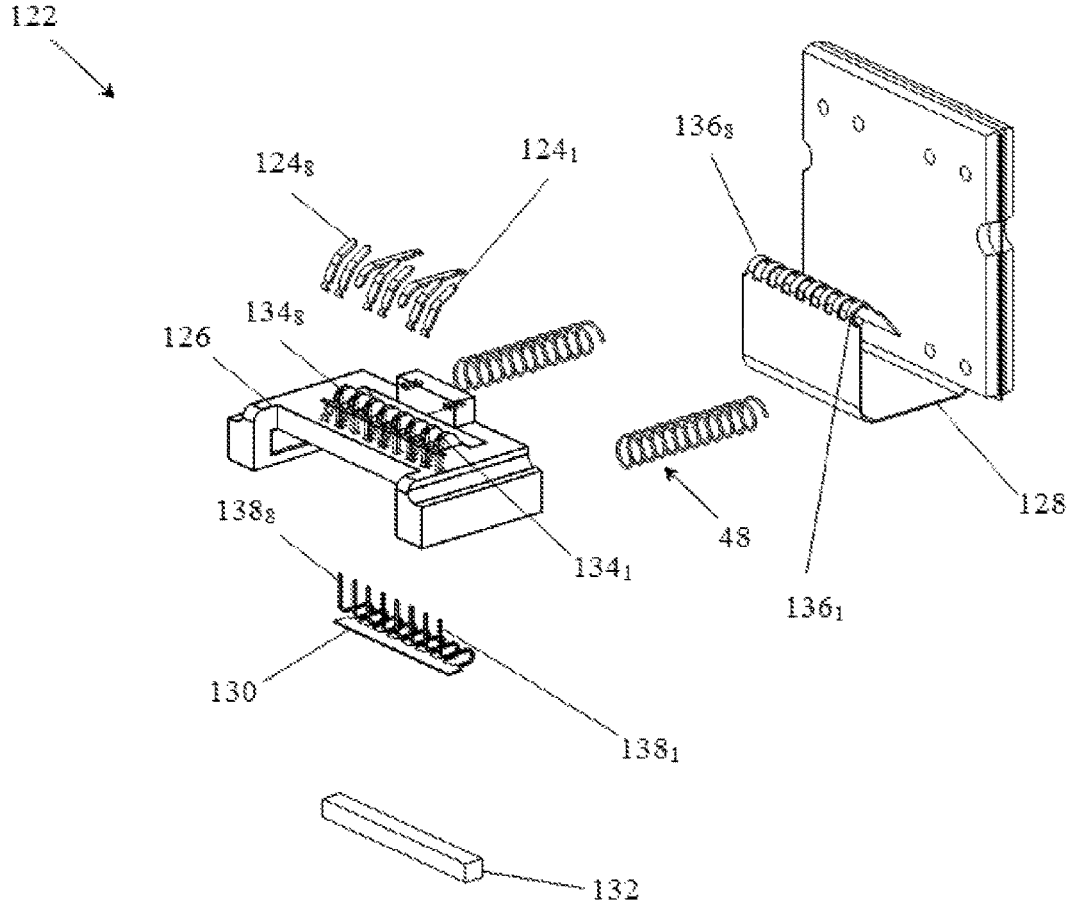
FIG. 18 is an exploded perspective view of the sled assembly of the jack of FIG. 16.

Referring now to FIGS. 16-21, in another embodiment according to the present invention, network jack 120 includes front housing 42, front sled assembly 122, IDCs 50, rear housing 52, and wire cap 54. IDCs 50, rear housing 52, and wire cap 54 of network jack 120 are the same as, or similar to the components of the previous embodiment. Jack 120 can additionally include alien crosstalk reducing foil as described in U.S. Pat. No. 8,167,661, incorporated by reference as if fully set forth herein. FIG. 18 shows an exploded view of the front sled assembly 122 with PIC 124, spring 138, spring connecting bar 130, springs 48, combined rigid and flex PCB (RFPCB) 128, RFPCB pad 136, sled 126, PIC support 134, and spring support 132. The subscript numbers of each PIC 124, PIC support 134, spring 138, and RFPCB pad 136 represent RJ45 pin positions as defined by ANSI/TIA-568-C.2. Front sled assembly 122 is fabricated by first inserting springs 138 into the sled 126 pockets, then spring support 132, RFPCB 128, PICs 124, and springs 48 are assembled. PICs 124 are assembled to sled by heat staking, sonic welding, mechanical staking, or similar processes. Spring support 132 is attached to sled 126 by staking or other processes.

Figure 16:
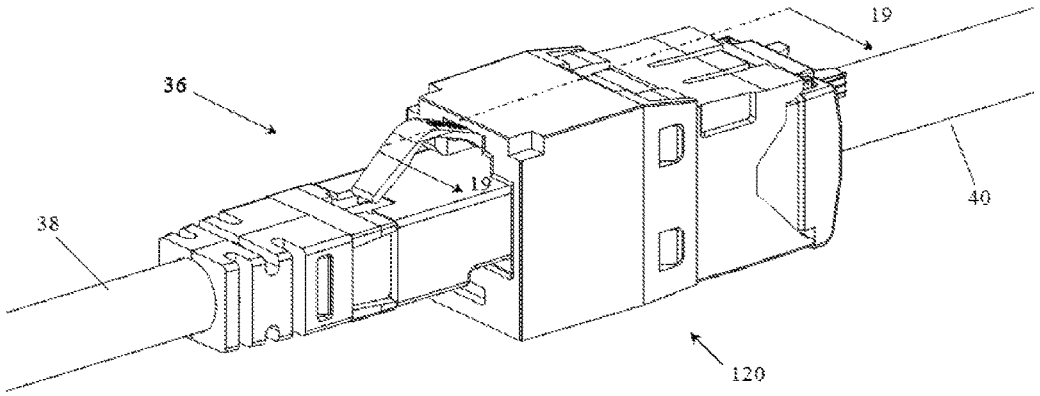
FIG. 16 is a perspective view of another plug/jack combination according to an embodiment of the present invention.
Figure 17:
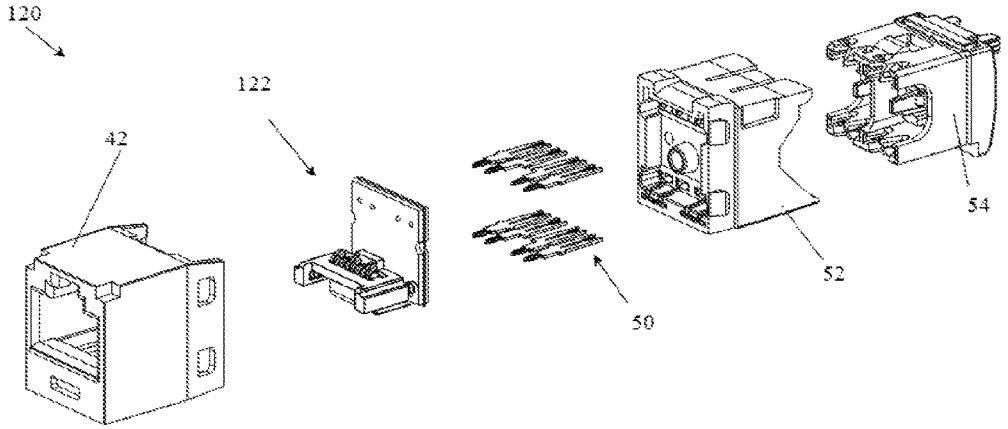
FIG. 17 is an exploded perspective view of the jack of FIG. 16.
Figure 19:
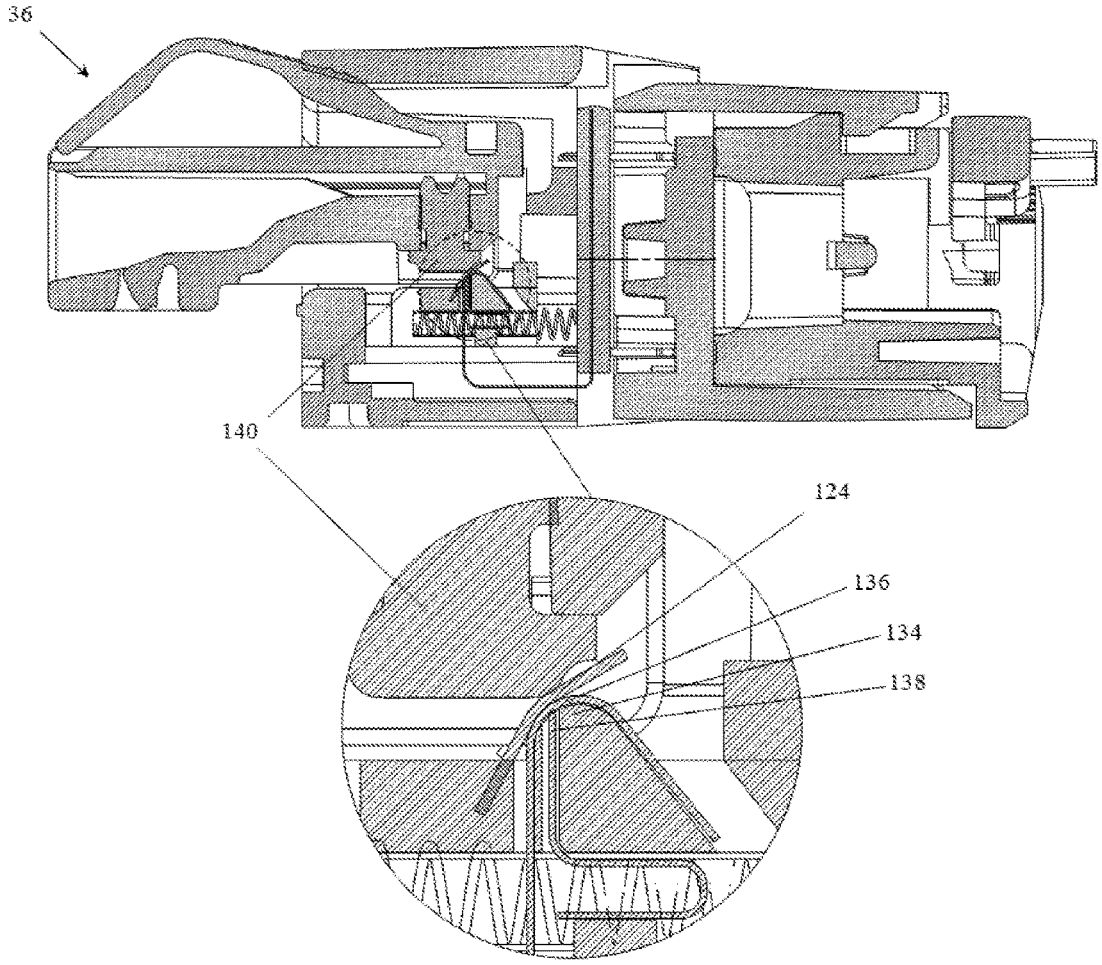
FIG. 19 is a cross-sectional view of the plug/jack combination of FIG. 16, taken along section line 19-19 in FIG. 16, with a detailed view.
Figure 20:
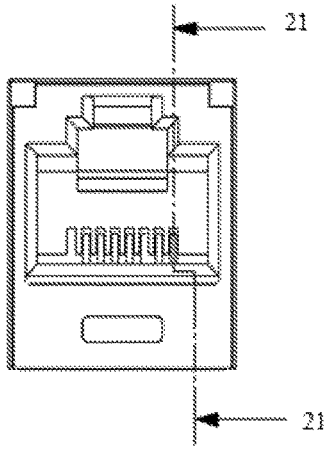
FIG. 20 is a front view of the jack of FIG. 16.
Figure 21:
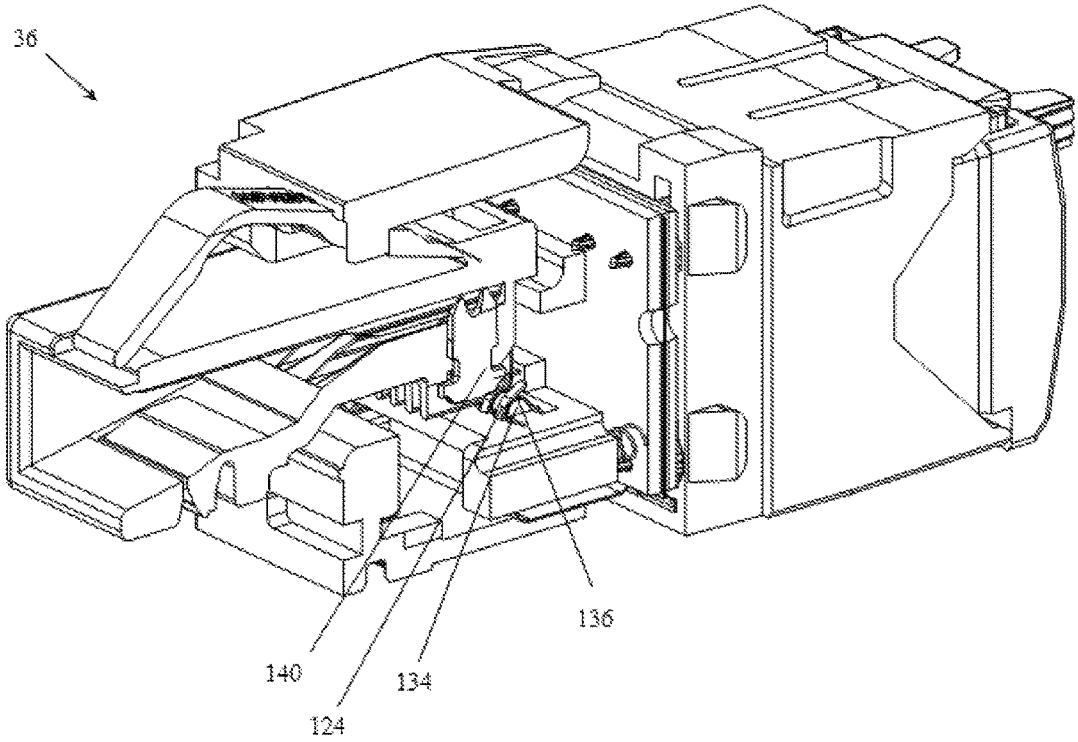
FIG. 21 is a fragmentary perspective view of the plug/jack combination of FIG. 16, partially sectioned about a plane defined by section line 21-21 as shown in FIG. 20.

FIG. 19 is a cross-sectional view of a mated plug 36 and jack 120 taken about section line "19-19" in FIG. 16 and illustrates plug 36, contact 140 and jack 120 PIC 124 in a mated position. RFPCB 128 is pinched between PIC 124 and PIC support 134. Spring 138 provides added force to maintain RFPCB pad 136 against PIC 124. FIG. 21 is a fragmentary isometric view of the mated plug 36 and jack 120 along section line 21-21 in FIG. 20.

Figure 22:
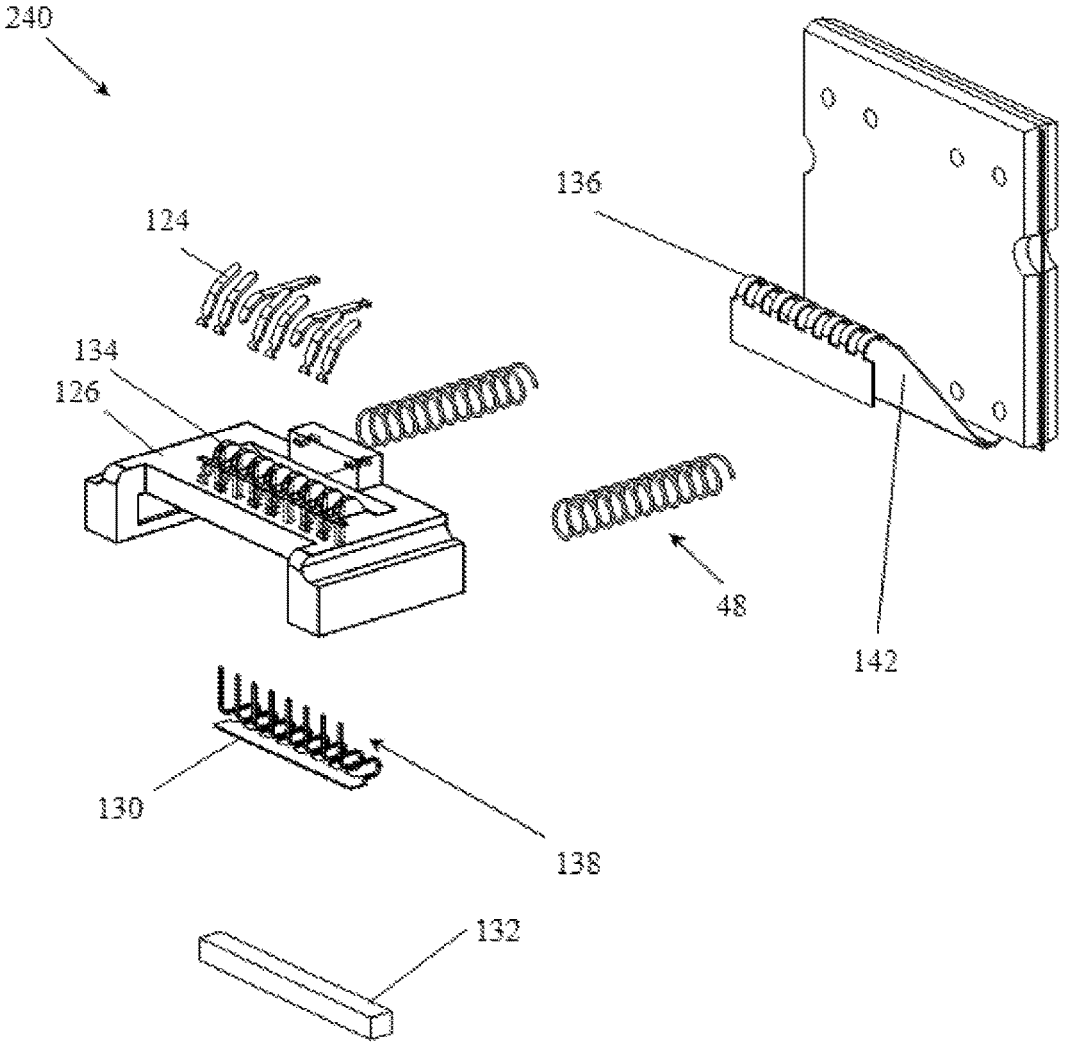
FIG. 22 is an exploded perspective view of another embodiment of a sled assembly according to the present invention with a rigid/flex combined PCB, similar to that used and shown in FIG. 17, but with an alternate routing of the flexible PCB around the sled assembly.

In an alternate embodiment of the present invention, an alternate sled assembly 240 (shown in FIG. 22) with a rigid flex PCB 142, routed over PIC support 134 from back to front, can be substituted in place of the sled assembly 122 in jack 120.

Figure 23:
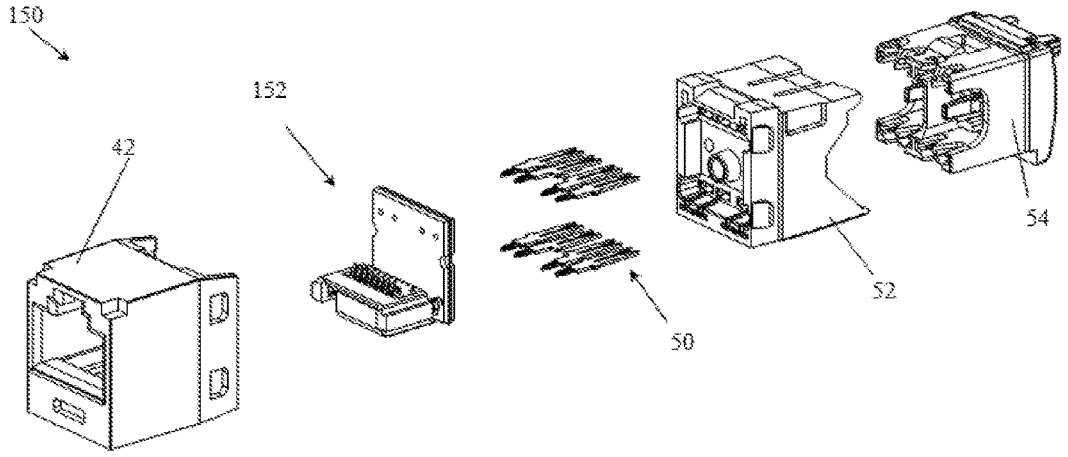
FIG. 23 is an exploded perspective view of another jack according to the present invention.
Figure 24:
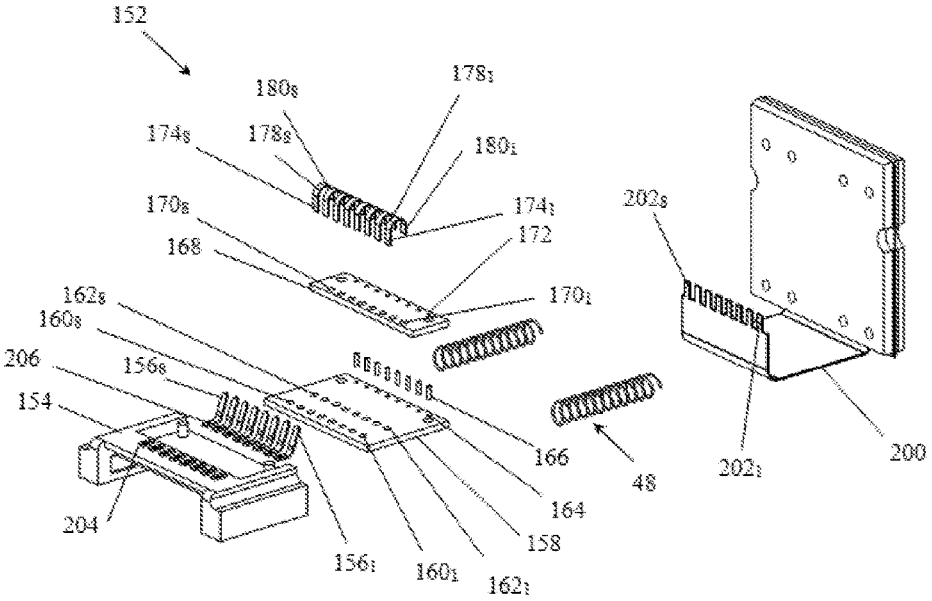
FIG. 24 is an exploded perspective view of the sled assembly of the jack of FIG. 23.

In another embodiment according to the present invention (shown in FIGS. 23-25) jack 150 includes sled assembly 152 with sled 154, PICs 156, first rigid PCB 158, second rigid PCB 168, PCB contacts 166, PIC support contacts 178, and RFPCB 200. PICs 156 are mechanically attached to sled 154 by staking, insert molding, or similar processes. PIC supports 178 are conductive and the ends 174 of the PIC supports 178 are assembled to first rigid PCB 158 in holes 162. PIC support ends 180 are assembled to the second PCB 168 in holes 170. First PCB 158 is connected to second PCB 168 thru PCB contacts 166 via holes 164 and 172. RFPCB 200 is connected to first rigid PCB 158 at holes 160 and fingers 202. PICs 156 are supported by PIC supports 178. When mated with the plug, PIC 156 deformation follows PIC support 178 radius. In an embodiment, PIC supports 178 are connected to first PCB 158 and second PCB 168 where one end of each PIC support is connected to a signal trace and the other end is connected to a compensation network (not shown). If the signal trace is on the second PCB 168, a PCB contact 166 can allow it to connect to RFPCB 200 thru first PCB 158.

Figure 25:
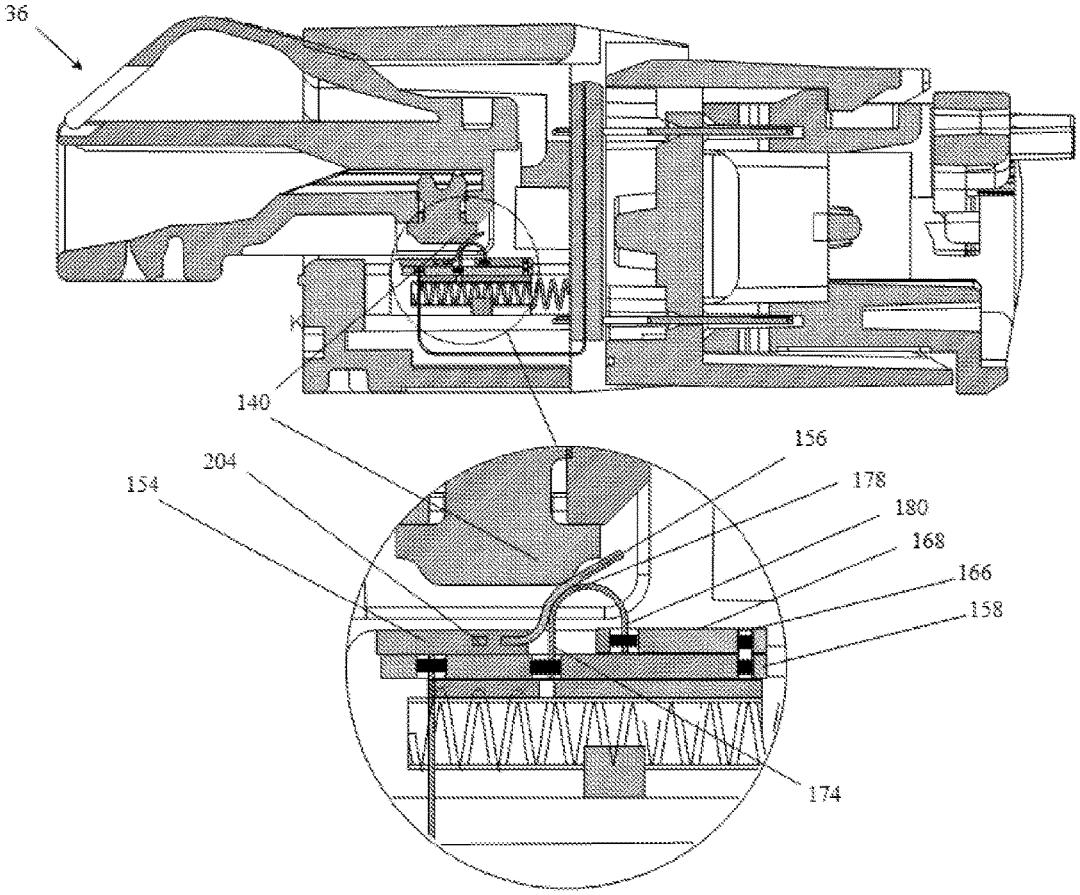
FIG. 25 is a cross-sectional view of a plug/jack combination using the jack of FIG. 23, with a detailed view.

FIG. 25 shows mated plug 36 and jack 150 (with sled assembly 152) cross-section view, taken about a plane similar to section line 19-19 in FIG. 16, and illustrates mated plug contact 140, PIC 156, PIC support 178. PIC support end 174 is connected to first PCB 158 and end 180 connected to second PCB 168. First PCB 158 is connected to second PCB 168 thru PCB contact 166.

Figure 26:
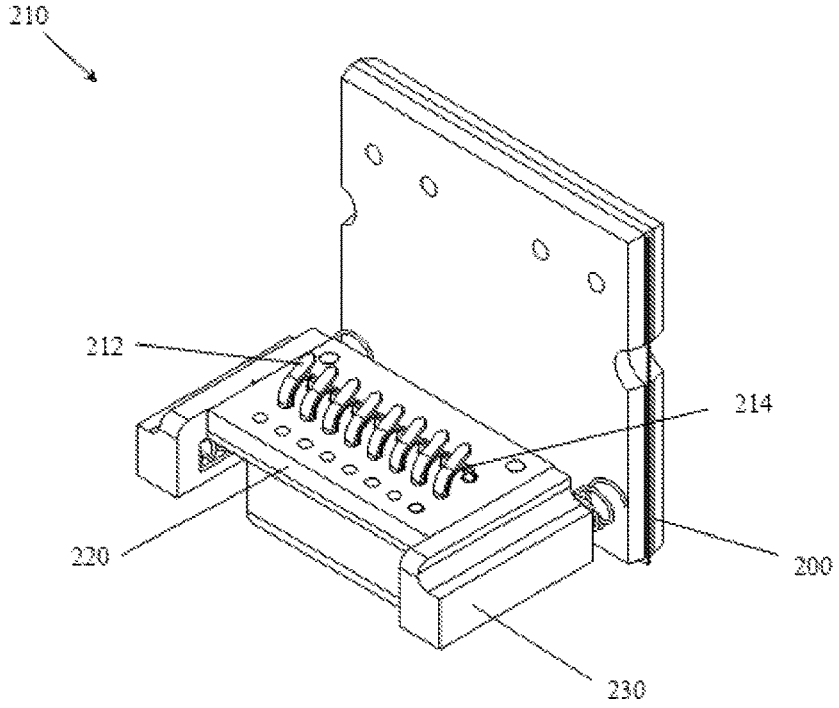
FIG. 26 is a perspective view of another embodiment of a sled assembly according to the present invention.
Figure 27:
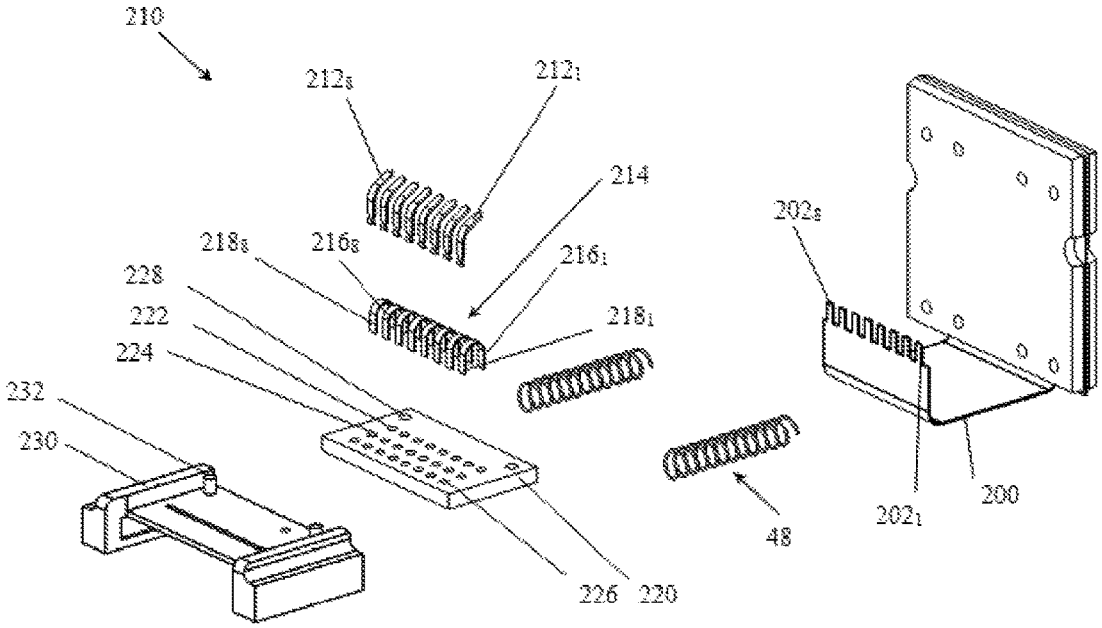
FIG. 27 is an exploded perspective view of the sled assembly of FIG. 26.
Figure 28:
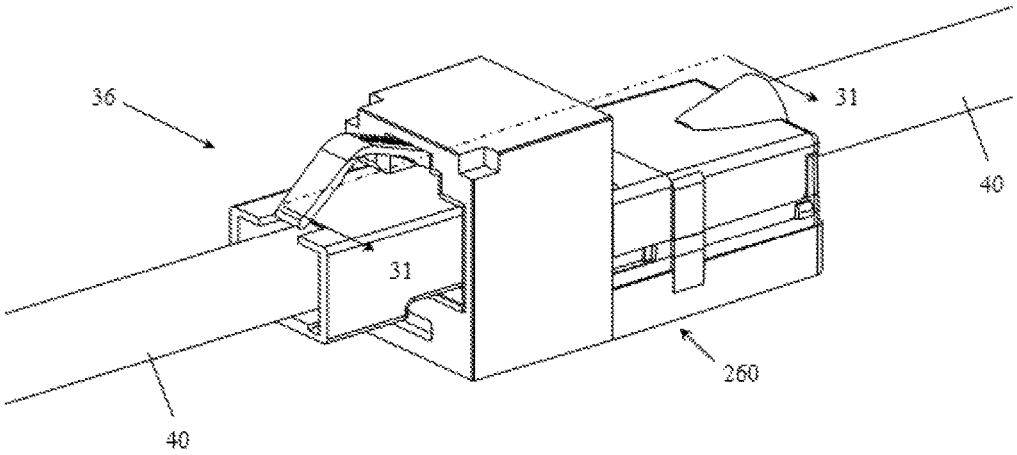
FIG. 28 is a perspective view of another plug/jack combination according to an embodiment of the present invention.
Figure 29:
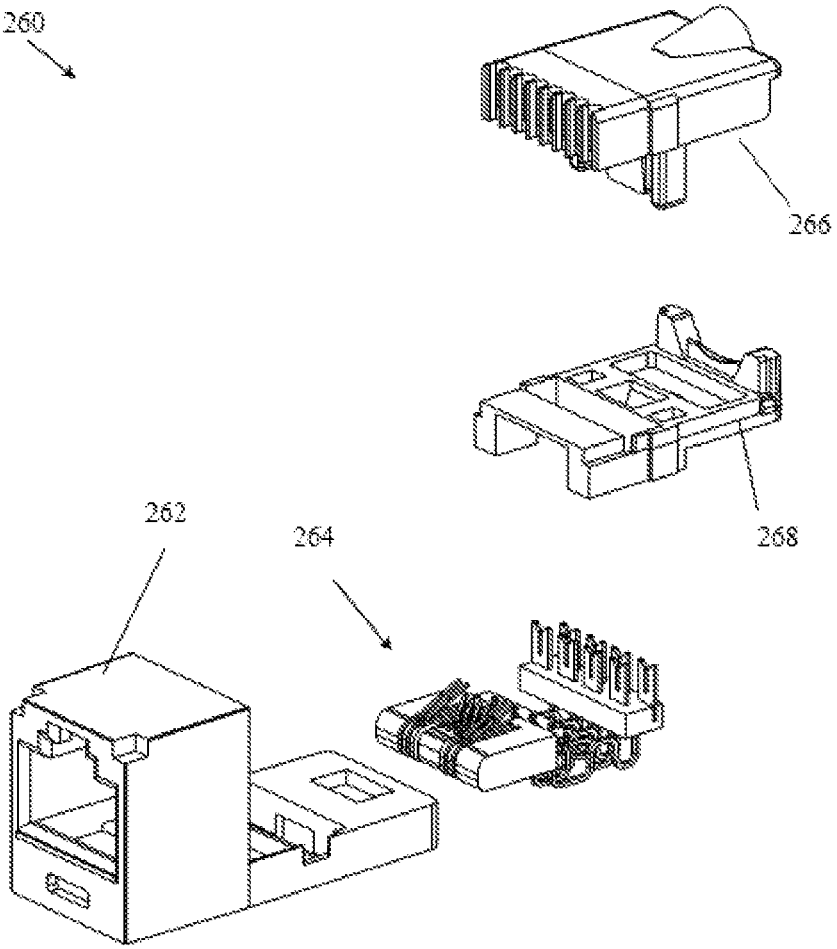
FIG. 29 is an exploded perspective view of the jack of FIG. 28.
Figure 30:
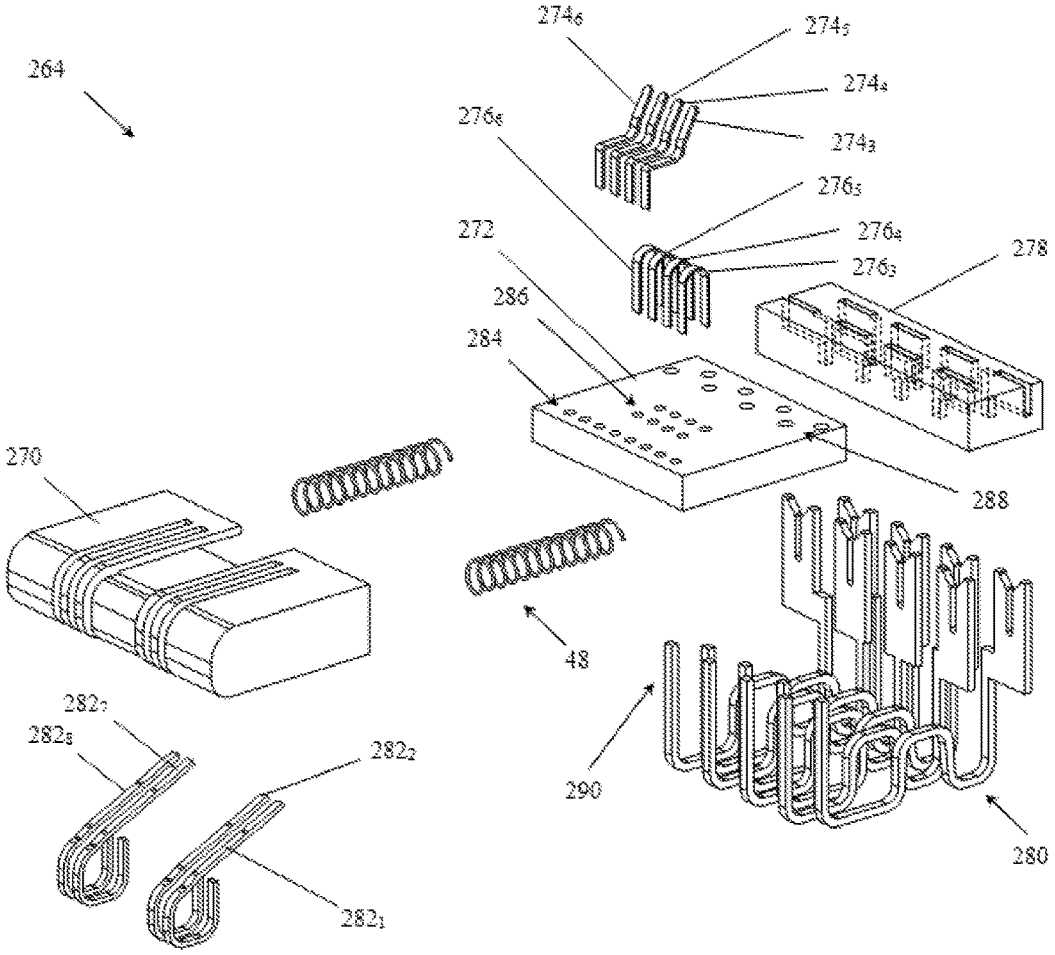
FIG. 30 is an exploded perspective view of the sled assembly of the jack of FIG. 28.
Figure 31:
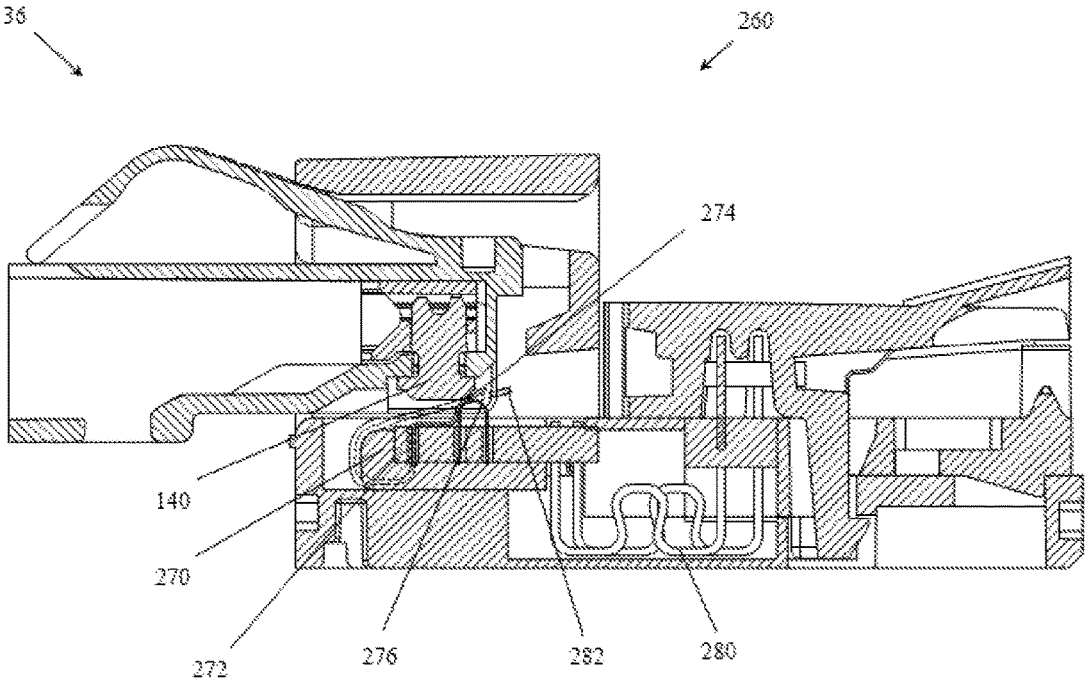
FIG. 31 is a cross-sectional view of the plug/jack combination of FIG. 28, taken along section line 31-31 in FIG. 28.
Figure 32:
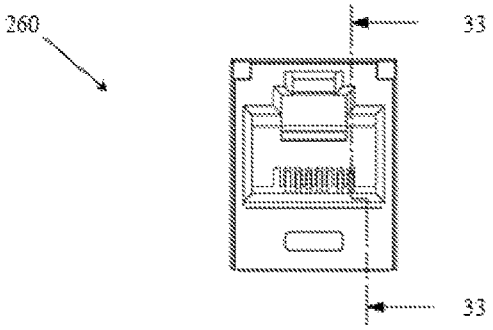
FIG. 32 is a front view of the jack of FIG. 28.
Figure 33:
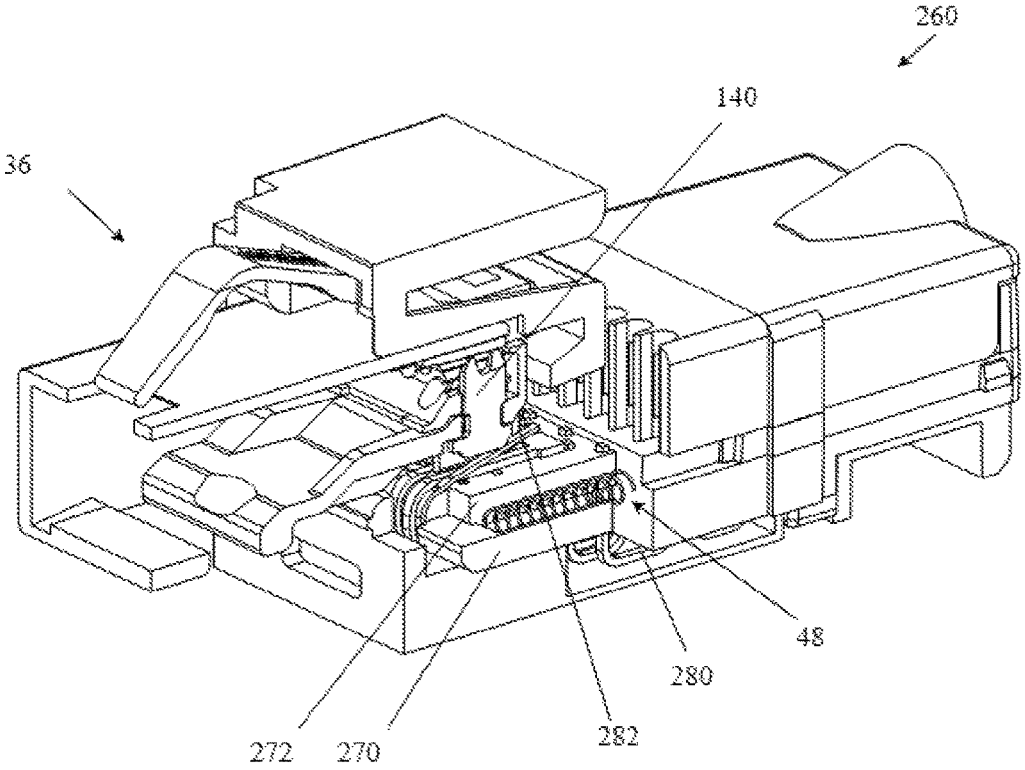
FIG. 33 is a fragmentary perspective view of the plug/jack combination of FIG. 28, partially sectioned about a plane defined by section line 33-33 as shown in FIG. 32.

FIGS. 26 and 27 illustrate another alternate embodiment with sled assembly 210, according to the present invention, which can be substituted in place of previously described sled assemblies in respective jacks. In this embodiment, two separate PCBs 158, 168 of sled assembly 152 can be combined (or the functionality thereof) into one PCB 220. PICs 212 and PIC support 214 ends 218 are assembled to PCB 220 via holes 224. PIC supports' other ends 216 are connected to PCB 220 via holes 222. PCB 220 is mechanically attached to sled 230 thru PCB holes 228 and sled posts 232. RFPCB 200 is connected to PCB 220 via holes 226 and RFPCB finger 202*s*. In an embodiment, one end of the PIC supports 214 is connected to compensation circuitry (not shown) and the other end is connected to respective signal traces.

In another embodiment according to the present invention (shown in FIGS. 28-33) modular jack 260 includes housing 262, sled assembly 264, sled holder 268, and wire cap 266. Sled assembly 264 includes sled 270, PICs 282, PICs 274, PCB 272, PIC support contacts 276, IDC holder 278, and IDCs 280. PICs 282 are attached to PCB 272 at holes 284 from bottom of the PCB and are wrapped around sled 270 from front at positions 1, 2, 7 and 8. PICs 274 are attached to PCB at holes 284 from top at positions 3, 4, 5 and 6. PIC supports 276 are assembled to PCB at holes 286 and support PICs 274. PIC supports 276 enable a short path to signal and compensation circuitry (not shown) that can be positioned on PCB 272. IDCs 280 are mechanically attached to IDC support 278 that is made of insulating material. IDC ends 290 are attached to PCB 272 at holes 288. Springs 48 fit within sled pockets and return sled 270, PICs 282, PICs 274, and PCB 272 assembly to front of the housing 262 in an unmated state. IDC 280 loop features provide added spring force while allowing sled 270 along with PCB 272 to travel with the plug. IDCs 280 are connected to PICs 282 and 274 via traces on PCB 272 (not shown). Longer PICs 282 allow jack 260 to mate with 6 position plugs without sustaining damage at PIC positions 1, 2, 7, and 8.

Springs 48 and 138 are shown as compression helical wound springs or stamped but they can be any configuration such as stamped, spiral or configured to be any compression, extension springs or torsion springs.

Other embodiments can have other combinations of previously described elements; for example, IDCs 86 can be combined with sled assembly 152 (minus RFPCB 200) where IDCs 86 then have wiping contact with PCB 158.

The aforementioned embodiments and their equivalents may help reduce the electrical distance between the source of crosstalk within the plug and at the plug/jack mating point, and any compensation network that may be employed within a communication jack. Furthermore, there may be an additional benefit of maintaining an approximately static crosstalk-to-compensation distance regardless of allowable post-latching plug over-travel.

Note that while this invention has been described in terms of several embodiments, these embodiments are non-limiting (regardless of whether they have been labeled as exemplary or not), and there are alterations, permutations, and equivalents, which fall within the scope of this invention. Additionally, the described embodiments should not be interpreted as mutually exclusive, and should instead be understood as potentially combinable if such combinations are permissive. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

I claim:

1. A communications jack, comprising:

a housing including a plug receiving aperture; and a sled assembly positioned at least partially within the housing, the sled assembly including a sled and a first printed circuit board (PCB) connected to the sled, the sled assembly further including a plurality of plug interface contacts (PICs) connected to the first PCB;

a second PCB positioned at least partially within the housing; and a plurality of intermediate contacts connected to the first PCB at first ends of the plurality of intermediate contacts and connected to the second PCB at second ends of the plurality of intermediate contacts opposite the first ends, wherein the sled assembly is movable within the housing when a communications plug is inserted in the housing.

2. The communications jack of claim 1, wherein the plurality of intermediate contacts have an "S"-shaped curve section.

3. The communications jack of claim 2, wherein the "S"-shaped curve section allows the plurality of intermediate contacts to be elastically deformed when the communications plug is inserted in the housing.

4. The communications jack of claim 1, wherein the first PCB is orientated horizontally in the housing and the second PCB is orientated vertically in the housing.

5. The communications jack of claim 1, wherein the plurality of PICs are connected to a first side of the first PCB and the plurality of intermediate contacts are connected to a second side of the first PCB opposite the first side.

6. A communications system, comprising:

a communications equipment;

a communications jack, the communications jack connected to the communications equipment and comprising:

a housing including a plug receiving aperture; and a sled assembly positioned at least partially within the housing, the sled assembly including a sled and a first printed circuit board (PCB) connected to the sled, the sled assembly further including a plurality of plug interface contacts (PICs) connected to the first PCB;

a second PCB positioned at least partially within the housing; and a plurality of intermediate contacts connected to the first PCB at first ends of the plurality of intermediate contacts and connected to the second PCB at second ends of the plurality of intermediate contacts opposite the first ends, wherein the sled assembly is movable within the housing when a communications plug is inserted in the housing.

7. The communications system of claim 6, wherein the plurality of intermediate contacts have an "S"-shaped curve section.

8. The communications system of claim 7, wherein the "S"-shaped curve section allows the plurality of intermediate contacts to be elastically deformed when the communications plug is inserted in the housing.

9. The communications system of claim 6, wherein the first PCB is orientated horizontally in the housing and the second PCB is orientated vertically in the housing.

10. The communications system of claim 6, wherein the plurality of PICs are connected to a first side of the first PCB and the plurality of intermediate contacts are connected to a second side of the first PCB opposite the first side.

* * * * *